US005787826A

United States Patent [19]

Vezzoli

[11] Patent Number: 5,787,826

[45] Date of Patent: Aug. 4, 1998

[54] CONTROL FOR THE AUTOMATIC REPLACEMENT OF THE LOWER THREAD BOBBIN FOR SEWING MACHINES

[76] Inventor: Osvaldo Vezzoli, via dei Videtti, 24064 Grumello del Monte, Italy

[21] Appl. No.: 633,466

[22] Filed: Apr. 17, 1996

[30] Foreign Application Priority Data

May 8, 1995 [IT] Italy ..... MI95A0918

[51] Int. Cl.[6] ..... D05B 59/04

[52] U.S. Cl. ..... 112/186

[58] Field of Search ..... 112/186, 279, 112/180, 181

[56] References Cited

U.S. PATENT DOCUMENTS

| | | | |
|---|---|---|---|
| 2,298,871 | 10/1942 | Cumfer | 112/186 |
| 2,438,459 | 3/1948 | Sebell | 112/186 |
| 2,690,725 | 10/1954 | Schumann et al. | 112/186 |
| 3,376,838 | 4/1968 | Schiffmacher et al. | 112/186 |
| 3,747,547 | 7/1973 | Mayer et al. | 112/186 |

*Primary Examiner*—Paul C. Lewis
*Attorney, Agent, or Firm*—Bucknam and Archer

[57] ABSTRACT

With planned sequential movements a mechanical pliers (1) is coaxially aligned with seat (5) of capsule (13) wherein the empty bobbin (14) of the lower thread of a sewing machine engages, caused to move forward until it engages with said capsule and to move backward, taking the same out from its seat, aligned with a collection basket (19) wherein capsule (13) and the empty bobbin (14) are unloaded, shifted and aligned coaxially with a loading cartridge (21) of capsules (13) containing bobbins (14) loaded with wound thread, caused to move forward until it engages and hooks on to the first of said capsules with loaded bobbins, then to move backward with said capsule with the bobbin, realigned coaxially with seat (15) of the sewing machine, caused to move forward up to the engagement of the capsule with the loaded bobbin in seat (15), and lastly is caused to move backward and placed in resting position, on prior release of the capsule with the loaded bobbin in the aforementioned seat. The operation is performed with full automation of the replacement stages of the lower thread bobbins with loaded bobbins.

5 Claims, 3 Drawing Sheets

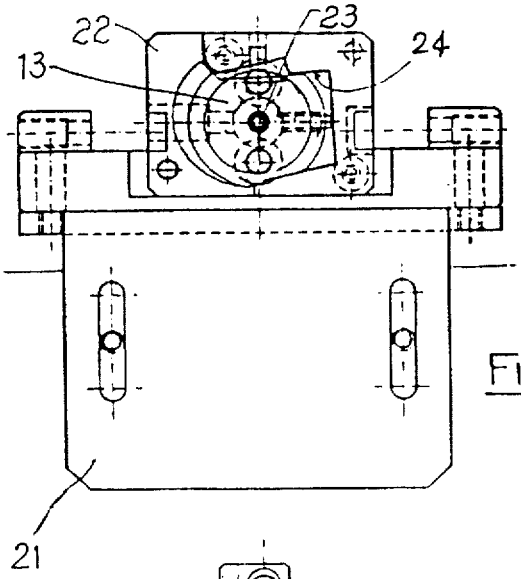
FIG. 2
FIG. 1A
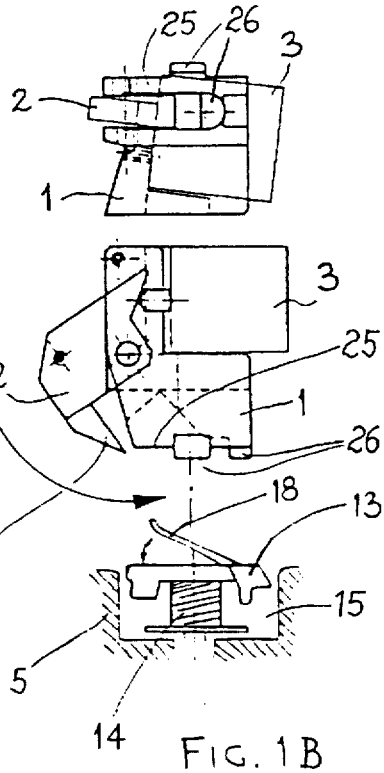
FIG. 1B
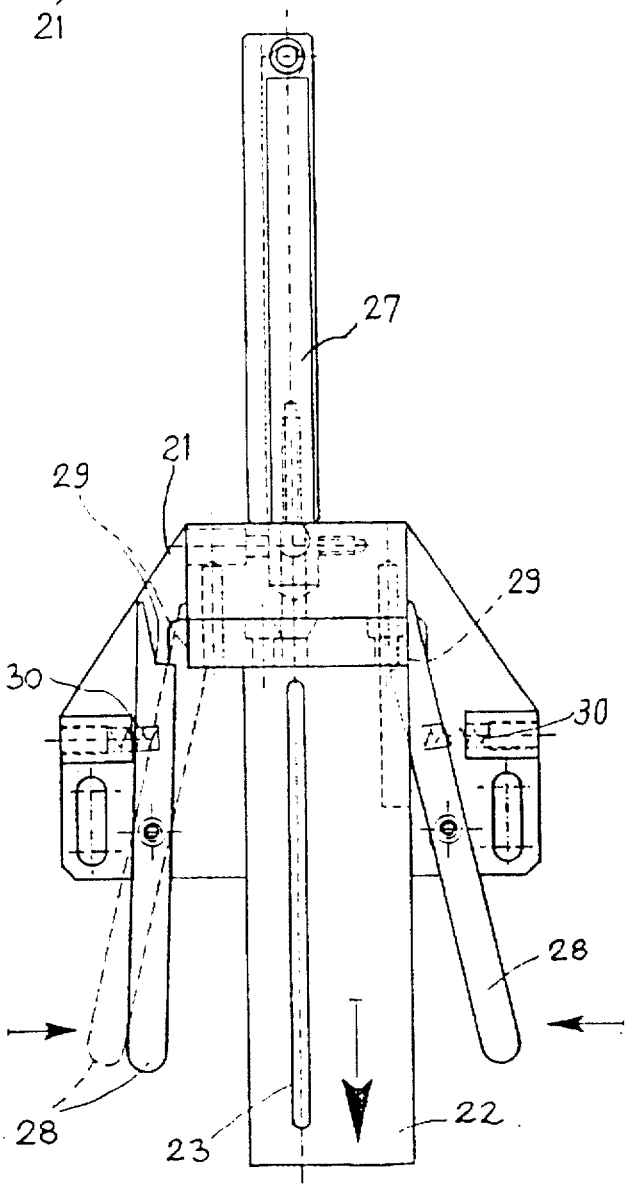
FIG. 3

CONTROL FOR THE AUTOMATIC REPLACEMENT OF THE LOWER THREAD BOBBIN FOR SEWING MACHINES

DESCRIPTION

This invention relates to a control for the automatic replacement of the lower thread bobbin for sewing machines, whereby mechanical pliers are sequentially actuated to remove a lower thread empty bobbin from its operating seat, unload the thread empty bobbin and replace it with another thread-loaded bobbin, taken from a special loading cartridge, wherein a plurality of said loaded bobbins is located. As is known, at present lower thread bobbins must be replaced by hand when they are empty. Because of the technical requirements which oblige said bobbin to be of a limited size, it is obvious that the amount of wound thread is proportionally limited. As a consequence, the replacement of empty bobbins by loaded bobbins is rather frequent.

Such operation, besides being complicated and uneasy, involves the standstill of the machine, the intervention of the operator for the replacement with ensuing periodical interruption of the working cycle and the obvious limitation of the real production possibilities within the frame of the industrial utilization for cloth-making and the like.

The object of this invention is to eliminate the above drawbacks. The invention, as is characterized by the claims, solves the problem by means of an automatic control of the lower thread bobbin for sewing machines, in particular for machines for industrial use for cloth-making and the like, by which invention the following results are obtained: on each sewing machine a loading cartridge is provided wherein a set of capsules is located containing bobbins loaded with wound thread; a device sliding transversely and longitudinally is aligned with the loading cartridge, which device carries a pliers; the movement device causes the above pliers to shift and align automatically in several positions, in alignment and sliding with the seat of the capsule, the collection basket, the loading cartridge, so that the automatic replacement is sequentially obtained of the capsule with a loaded bobbin directly in the sewing machine; the shifting of the handling means is coordinated through programmable electronic control devices. The advantages achieved by this invention lie essentially in that all the sliding, shifting, loading and unloading motions are fully automatic and take place in a rapid, precise and autonomous manner, with no need for hand operations, with part reduction of the operating times; such automation allows improvement of the working activity of industrial and non industrial sewing machines, utilized for the working of mass produced products for clothing and the like. Another advantage is that the operators can manage more easily several machines at the same time, while the loading cartridge can be preloaded, even in another location, and put at the disposal of said operators, who replace them only upon exhaustion of the capsule with full bobbins loaded on the same and utilized gradually during the sewing operating stages.

The invention is described in detail in the following according to a particular embodiment, proposed only by way of non limitative example, with reference to the attached drawings, wherein:

FIG. 1A shows a plan view of a mechanical pliers;

FIG. 1B shows a front view of a mechanical pliers;

FIG. 2 shows a front view of a seat for cartridges for loading capsules with lower thread bobbins, complete with said cartridge;

FIG. 3 shows the plan view of the same seat and the same cartridge of FIG. 2;

Figure 4:
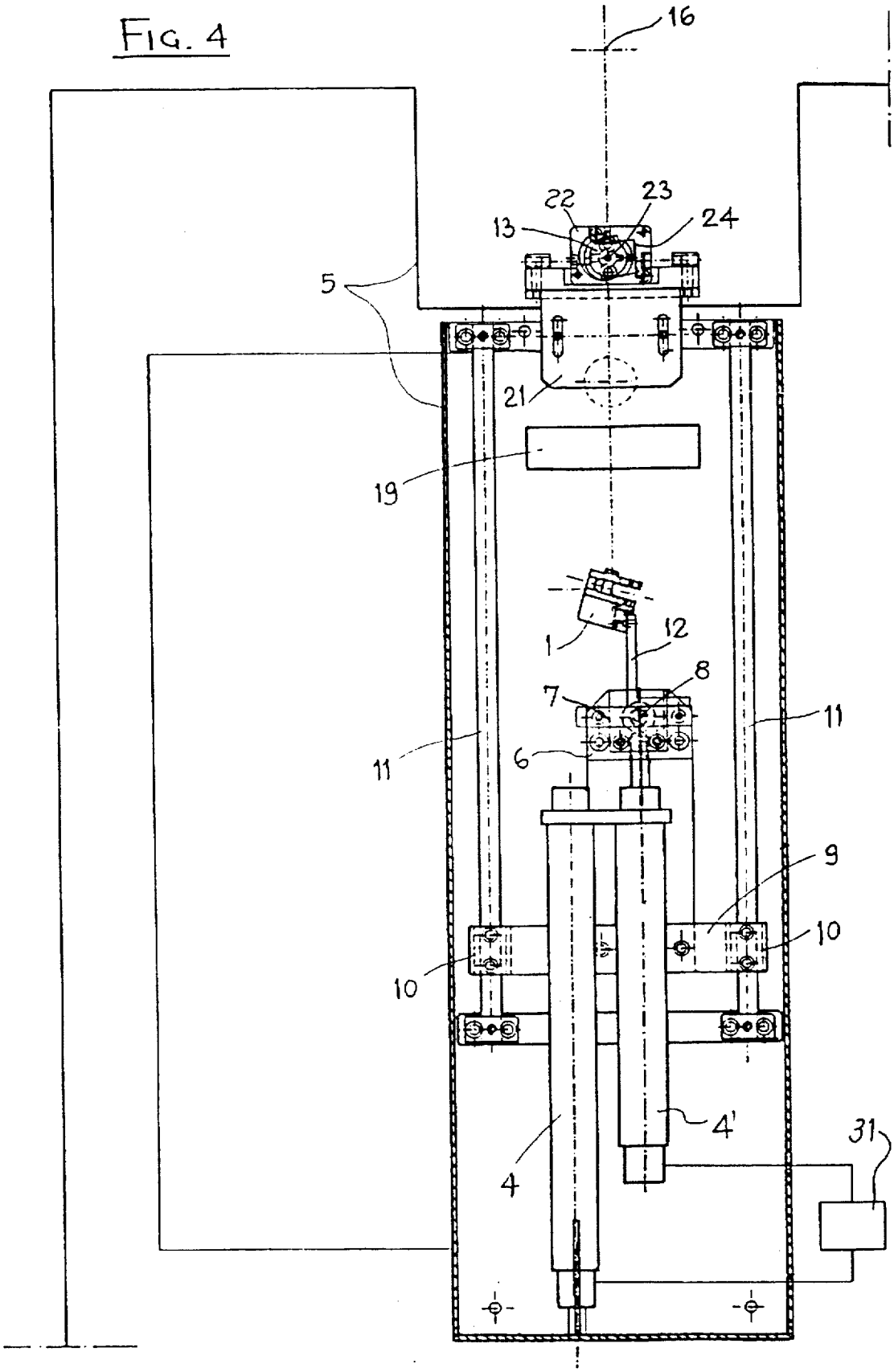
FIG. 4 shows the front view of a complete control applied to a sewing machine.
Figure 5:
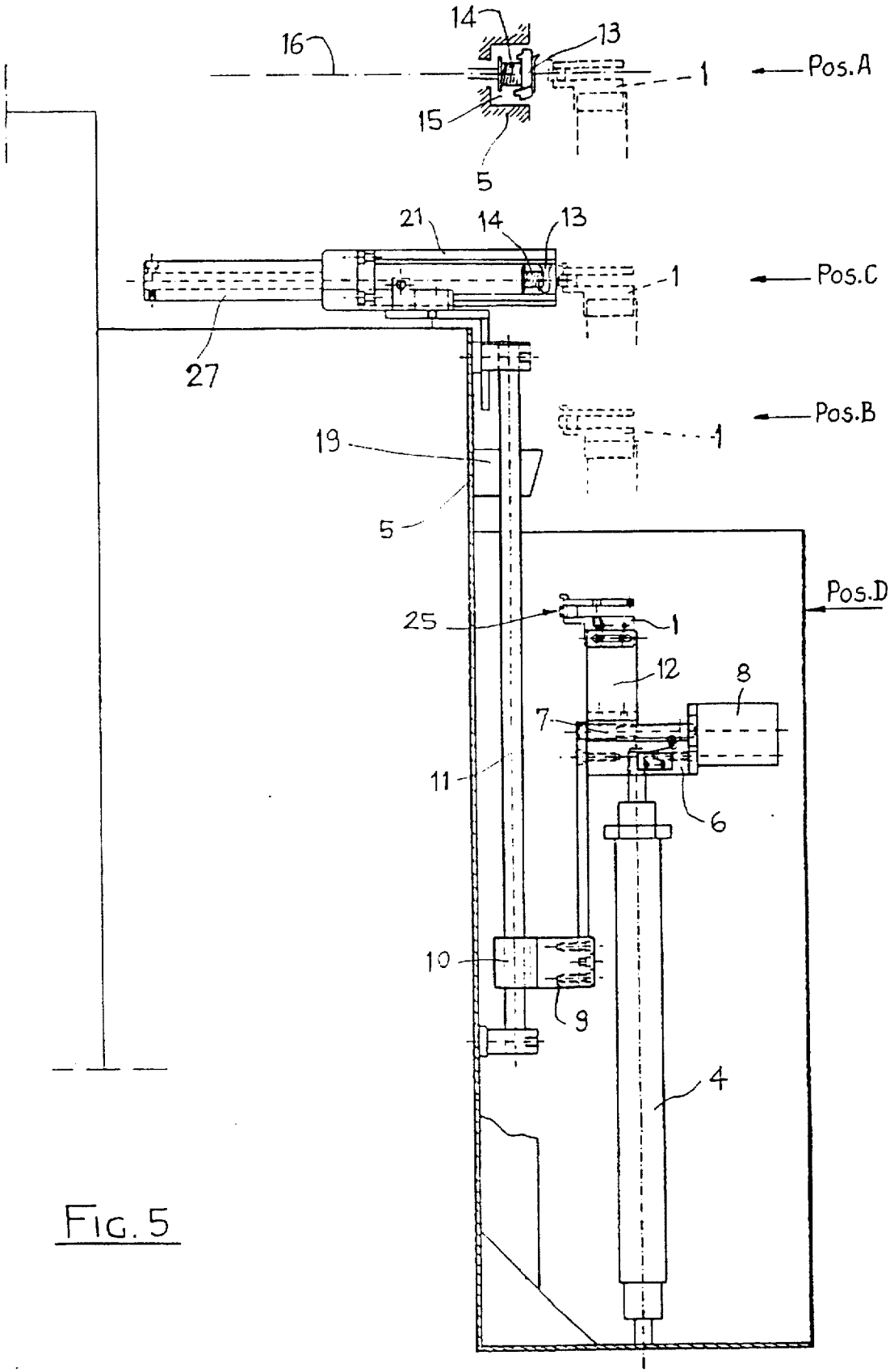
FIG. 5 shows the side view of the same control of FIG. 4.

The figures illustrate a control for the automatic replacement of the lower thread bobbin for sewing machines, in particular for industrial sewing machines, substantially comprising a mechanical pliers (1) whose mobile arm (2) is activated by means of a piston (3). In particular, and by way of non limitative example, piston (3) is of the pneumatic type, as is the device for the sliding handling, which is formed by a couple of pistons (4) (4') vertically oriented on the side of a sewing machine (5), in alignment with the part of operating head comprising the dog and the cloth-presser foot.

In the embodiment illustrated by way of example, the handling comprises two pistons (4) and (4'), whose function is to support and cause the sliding of the support structure (6) on which a runner (7) activated by a piston (8) can freely slide orthogonally.

It must be stressed that the handling with the aforementioned pneumatic pistons has been illustrated and described according to a preferred embodiment from both the economic and functional point of view. In particular the coupling of pistons (4) and (4') has been used to restrain the stroke of the individual details. In any case, the above solution has been proposed only by way of non limitative example; in fact, handling may also be obtained by other known means of a mechanical, hydraulic, electromechanical, mixed nature or the like. In its vertical sliding the whole is kept regularly on line by means of a transverse carriage (9), which comprises two side supports (10) which run along vertical guides (11).

To runner (7) a supporting plate (12) is coupled to which the fixed part of the mechanical pliers (1) is connected. During operation of the sewing machine (5), a capsule (13) containing a lower thread bobbin (14) is engaged in its own seat (15) under the operating head.

When the thread wound on bobbin (14) ends, sewing stops and said bobbin must be replaced by a thread loaded bobbin.

The stopped feed of the lower thread causes the start of the operating stage of the invention, controlled by means of a programmable electronic device (31) (illustrated in FIG. 4 only) which acts on the electrovalves that activate pistons (3), (4), (4') and (8), regulating the stroke and the alignment in the required positions by means of proximity sensors, optical sensors or sensors of other suitable types, and/or by means of ends-of-stroke. Pistons (4) and (4') extend sequentially their frames until they lift the support structure (6) up to such a height as to coaxially align pliers (1) with the upper axis (16), corresponding to the axial position of capsule (13) with bobbin (14) without thread, positioned on seat (15). (Position A).

Now steps in piston (8) which, from the resting position pushes forward runner (7) until the mechanical pliers (1), applied at the top of the supporting plate (12) is brought in substantial contact with the front part of capsule (13), engaged in its own seat (15).

Piston (3) steps in causing the rotation of the mobile arm (2), until its spout-end (17) engages with the mobile lever (18) of capsule (13).

Said lever (18), as is known, hooks stably the empty bobbin (14), so that the following backwards movement of piston (3) up to its resting position causes the removal of both the bobbin and the capsule from seat (15), and their lasting connection with said mechanical pliers.

In the following stage, pistons (4) (4') re-enter, until the mechanical pliers (1) is brought in alignment with a basket (19) where, after a forward movement of runner (7) and the opening of the mobile arm (2), both the empty bobbin and the corresponding capsule are put down. (Position B).

Runner (7) is caused again to move backwards up to the end-of-stroke, and pistons (4), (4') extend again, bringing this time the mechanical pliers (1) into coaxial alignment with the restraining seat of a cartridge (21) loading capsules (13) with bobbins (14) loaded with wound thread. (Position C).

Piston (8) again pushes forward runner (7) until the mechanical pliers (1) is in substantial contact with the front part of the first capsule (13), with the related loaded bobbin (14) located in cartridge (21).

The rotation of the mobile arm (2) of pliers (1), induced by piston (3), causes the hooking of the aforementioned first capsule (13) with the related bobbin (14) to spout (17) of said arm.

Once hooking has taken place, piston (8) again causes runner (7) to move backwards up to the end-of stroke, pistons (4) (4') extend until the mechanical pliers (1) is coaxially realigned with seat (15) of the sewing machine (Position A), piston (8) causes runner (7) to move forward until the loaded bobbin (14) with the related capsule (13) is inserted in said seat, piston (3) causes the backward rotation of the mobile arm (2), with ensuing unhooking from said bobbin and said capsule and lastly runner (7) is repositioned at the end of stroke, together with pistons (4) (4'), which are lowered to a resting position (Position D), while the sewing machine restarts it operation.

The loading cartridge (21) is substantially constituted by a horizontal external box-shaped body (22) wherein a longitudinal pin (23) is comprised which forms the support for the loaded bobbins (14) with the relevant capsules (13). On the front a shaped stirrup (24) is provided which forms the bearing of said bobbin-capsule assemblies and which performs the function of a guide for the engagement of the mobile pliers (1); in its turn, the front part (25) of said pliers (1) is provided with guide elements (26) which shift with the configuration of said capsules. This has the purpose of ensuring always and certainly the coupling of the parts, their self-alignment and their sure connection during the catchings of the mobile arm (2) with spout (17).

The back part of the loading cartridge (21) comprises a spring-pusher (27) which keeps the bobbin-capsule assemblies always pushed towards the outlet.

Two side levers (28) with pawls (29) and elastic hooking side means (30) permits loading cartridge (21) to maintain the correct position during normal operation, and to unhook the same in a quick and safe manner for its replacement with another similar one, once it is unloaded.

In the described operating cycle a possible further stage may be added related to the control of the loading cartridge (21). In this case, pliers (1), before being brought to the resting position, after the replacement of an empty bobbin, is aligned again with said loading cartridge (21), and, with the forward motion of runner (7), it is controlled through a microsensor inserted in the device, if there still are capsules (13) with the relevant loaded bobbins (14) in its inside.

In case of absence, a sound or light or mixed signal is emitted which informs the operator about the need of a replacement operation of the empty cartridge with a loaded one, before the machine exhausts the last bobbin.

While this invention has been illustrated and described according to an embodiment proposed by way of example, it will be apparent to those skilled in the art that various modifications may be made in the mechanical details, the operating sequence, the orientation of the parts, the controls and the activating means thereof, without falling outside its field and scope.

I claim:

1. A control for the automatic replacement of the lower thread bobbin for sewing machines wherein the various operating stages thereof are regulated by a programmable activating system, said control comprising:

a) a mechanical pliers (1) including a mobile arm (2) with an end spout (17) adapted to hook a mobile lever (18) of a capsule (13) coupled to a bobbin (14);

b) a first actuating piston (3) adapted to act on said mobile arm (2) of said mechanical pliers;

c) a supporting plate (12) supporting said mechanical pliers (1) and said first actuating piston (3);

d) a runner (7) connected to said supporting plate (12);

e) a support structure (6) supporting said runner (7) for sliding transverse movement imparted by second actuating piston (8) acting on said runner (7);

f) at least one third actuating piston (4,4') acting on said support structure (6);

g) means for guiding translatory movement of said support structure (6) imparted by said at least one third actuating piston (4,4'), said means including a transverse carriage (9) having a pair of side supports (10) adapted for sliding movement on a pair of guides (11); and h) a releasably supported interchangeable loading cartridge (21) including a support body (22) adapted to hold a plurality of coaxially aligned replacement bobbins (14) each coupled to a capsule (13).

2. The control as defined in claim 1, wherein said first actuating piston (3), said second actuating piston (8), and said at least one third actuating piston (4,4'), are pneumatic pistons operated by electrovalves for regulating their stroke and the alignment of said mechanical pliers (1) and wherein sensors control said electrovalves.

3. The control as defined in claim 2, wherein said mechanical pliers (1) includes a front part (25) having guide elements (26) shaped complementary to the external shape of said capsule (13), whereby upon hooking of said spout (17) of the mobile arm (2) with the mobile lever (18) of the capsule (13), the guide elements (26) self-aligningly engage with the capsule (13).

4. A control for the automatic replacement of the lower thread bobbin for sewing machines, comprising:

a) a mechanical pliers (1) including a mobile arm (2) with an end spout (17) adapted to hook a mobile lever (18) of a capsule (13) coupled to a bobbin (14);

c) motion means supporting said supporting plate (12) controlled by a programmable activating system which regulates the position and activation of said mechanical pliers (1) in the various operating stages; and d) a releasably supported interchangeable loading cartridge (21), comprising an external box-shaped body (22) aligned with the transverse stroke of said mechanical pliers (1), a pin (23) arranged in said box-shaped body (22) for supporting a plurality of coaxially aligned replacement bobbins (14) each coupled to a replacement capsule (13), a back-pusher (27) which biases said plurality of aligned replacement bobbins (14) coupled to said replacement capsules (13) towards an outlet of said body (22), said outlet comprising a shaped stirrup (24) against which said replacement bobbins (14) and said replacement capsules (13) bear and which is complementary to the external configuration of said mechanical pliers (1) so that there is self-alignment of the parts during the hooking stage of said spout (17) of said mobile arm (2) with said mobile lever (18) of each said capsule (13).

5. A control for the automatic replacement of the lower thread bobbin for sewing machines, comprising:

a) a mechanical pliers (1) including a mobile arm (2) with an end spout (17) adapted to hook a mobile lever (18) of a capsule (13) coupled to a bobbin (14);

b) a supporting plate (12) supporting said mechanical pliers (1);

c) motion means supporting said supporting plate (12) controlled by a programmable activating system which regulates the position and activation of said mechanical pliers (1) in the various operating stages; and d) a releasably supported interchangeable loading cartridge (21) including a support body (22) adapted to hold a plurality of coaxially aligned replacement bobbins (14) each coupled to a replacement capsule (13), said body (22) being movable and replaceable and is engaged in loading cartridge (21) by pawl levers (28) with elastic closing means (30).

* * * * *